US006247659B1

(12) United States Patent
Devereux

(10) Patent No.: US 6,247,659 B1
(45) Date of Patent: Jun. 19, 2001

(54) MILLING AND PULVERISING APPARATUS AND METHOD

(75) Inventor: Ian Devereux, Manukau (NZ)

(73) Assignee: Rocklabs Limited, Auckland (NZ)

( * ) Notice: Subject to any disclaimer, the term of this patent is extended or adjusted under 35 U.S.C. 154(b) by 0 days.

(21) Appl. No.: 09/295,014

(22) Filed: Apr. 20, 1999

(51) Int. Cl.[7] ..... B02C 17/20

(52) U.S. Cl. ..... 241/30; 241/184; 241/266; 241/175

(58) Field of Search ..... 241/175, 184, 241/266, 30

(56) References Cited

U.S. PATENT DOCUMENTS

| | | | | |
|---|---|---|---|---|
| 1,331,964 | * | 2/1920 | Newhouse | 241/184 |
| 1,388,463 | * | 8/1921 | Hardinge | 241/184 |
| 2,297,391 | | 9/1942 | Conradi . | |
| 2,431,870 | * | 12/1947 | Huenerfauth et al. | 241/184 |
| 3,602,443 | * | 8/1971 | McShirley | 241/175 |
| 5,556,044 | | 9/1996 | Hobson . | |

FOREIGN PATENT DOCUMENTS

| | | | |
|---|---|---|---|
| 570814 | * | 3/1988 | (AU) . |
| 1285851 | | 12/1968 | (DE) . |
| 2218318 | | 10/1973 | (DE) . |
| 0173072 | | 7/1985 | (EP) . |
| 1047002 | | 5/1964 | (GB) . |

* cited by examiner

*Primary Examiner*—Mark Rosenbaum
(74) *Attorney, Agent, or Firm*—Mark B. Garred; Stetina Brunda Garred & Brucker

(57) ABSTRACT

The specification describes a method and associated apparatus for pulverising materials, wherein the pulverising apparatus includes a receptacle, two or more pulverising weights and a driving mechanism linked to the receptacle wherein the pulverising weights are disposed substantially horizontally with respect to the receptacle.

The method of operating the apparatus includes the steps of:

a) placing the pulverising weights in the receptacle, wherein the pulverising weights are disposed substantially horizontally with respect to the receptacle, and b) activating the driving mechanism, causing material(s) retained in the receptacle to be ground by the pulverising weights.

18 Claims, 1 Drawing Sheet

MILLING AND PULVERISING APPARATUS AND METHOD

TECHNICAL FIELD

This invention relates to apparatus used to mill or pulverise materials, especially ore.

Reference throughout this specification will now be made to the material as being ore in the form of rocks.

It should be appreciated that other materials can be used with the present invention. These materials may for example include sand, coal, wood, slag, clay or sinter.

BACKGROUND ART

A number of chemical analyses require the sample to be tested in a fine homogeneous powdered form. This is the case with some tests performed on ore samples, which require the sample to be pulverised into particles of diameters smaller than 75 microns.

Some analyses also require large quantities of the sample to be sampled. The analysis in question may consume a large amount of the sample, or several analyses may be required to ensure the results obtained are repeatable.

In the case of analysing the chemical components of ore in the form of rocks, the preparation of the sample proposes several problems. Large quantities of rock need to be pulverised into a very fine powder for some giving a homogeneous powdered sample.

An existing method of pulverising rock samples is to use a ring mill.

A ring mill consists of a bowl within which is placed one or more solid rings and a centrally located solid puck. A lid is also provided which can clamp down solidly on the bowl. The bowl is fixed to a horizontal platform mounted on a set of springs. A driving motor which vibrates the bowl is attached to the underside of the platform.

When a rock sample is placed inside this mill the larger particles are crushed between the outer ring and the bowl walls, between the rings, and between the puck and adjacent rings. Crushing also occurs between the upper and lower surfaces of the ring, the bowl and lid.

The ring mill is driven until the sample within consists of a homogeneous mix of particles of the right size.

This mill design is effective but has a major problem which disadvantages the operator.

A ring mill can only process small amounts of sample in one processing operation. If too much sample is added to the bowl it ends up choking up the puck and rings, limiting the movement of the rings when the device is driven. This causes a severe problem, as pulverisation of enough sample for an analysis turns into a long and tedious job, with several processing stages being required.

In some instances crushing of the sample is required before it is fed into the ring mill. If the materials are too large or coarse the ring mill can not effectively pulverise the sample, or will require an extremely long pulverising period within which to process a sample to their required particle size and homogeneity.

Another type of pulverising mill is the discus mill described in Australian Patent No. 570814.

The discus mill uses the same driving mechanism as a standard ring mill, but replaces the ring and central puck with a discus which has a convex curved base. The discus also includes a cone shaped aperture located off centre to the middle of the discus. This mill employs a concave shaped base to its bowl, in which the discus moves.

When vibrated the discus is able to run up the walls of the bowl, while trapping and pulverising particles of the sample underneath when falling down from the side walls of the bowl. The aperture in the discus acts to distribute material under the discus.

The discus mill solves some of the disadvantages involved with using a ring mill because it can process a large amount of sample. However, the discus mill still relies on long processing times to pulverise a sample down to the required sized particles.

This results in slow sample preparation. An operator is again limited in the amount of sample they can process in a particular period of time.

An additional problem associated with discus mills is removal of the sample once pulverisation has occurred. The discs employed in a conventional discus mill can weigh in excess of 25 kilos, which operators find difficult to lift and move easily. Consequently a hydraulic or pneumatic lifting device is required to remove the discus from the mill.

This results in increased expense, as more equipment is required for sample preparation, and also slows down sample preparation, the operator has to control and manoeuvre a secondary piece of mechanical apparatus to allow the sample to be removed from the Mill.

When used extensively the discus from a discus mill is reduced in weight by the abrasion of the sample it grinds. The performance of the discus will fall steadily with use as its weight decreases, until it must be replaced because pulverising times are too long.

In a single discus mill the base of the bowl used slowly wears away until the bowl needs replacing. The bowl is an expensive component, and because in single discus mills a curved bowl base is used, the bowl cannot easily be refurbished with a replacement base plate.

A different type of pulverising apparatus, termed a ball mill may be used in continuous flow processing applications. Flow processing-mill apparatus is used in a production line assembly where material is continually added to the milling apparatus in a coarse form and removed from the apparatus in a fine ground form. This may be contrasted with batch processing operations where a milling device contains a set amount of sample and is operated for a measured period of time, stopped and then the sample removed.

Ball mills used in continuous flow processing applications may be configured in a number of ways. However, all ball mills include a main receptacle to which is added a number of balls, along with the material to be ground. The receptacle is then rotated, or generally agitated to move the balls against the material to be ground.

As can be appreciated by one skilled in the art ball mills do not operate as efficiently as other milling and pulverising devices. The ball will have only a point contact with another ball and the material to be pulverised in between the two balls. Only a small amount of material will be pulverised with each impact of a ball, due to the small surface area contact that occurs. This make ball mills relatively inefficient when compared to other forms of milling apparatus.

A milling and pulverising device which overcame the problems listed above would be a great advantage over the existing prior art. Such a machine would greatly increase the speed of sample preparation by reducing the time periods involved in preparing a batch of sample and by processing more sample in one batch than normally possible.

Some laboratories process thousands of samples a day and therefore any reduction in pulverising time is a considerable cost and labour saving. In addition, a pulverising and milling device which accepted coarse material would again speed up the sample process, eliminating the need for crushing of a sample.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided pulverising apparatus including a receptacle, and at least two pulverising weights, characterised in that the pulverising weights are disposed substantially horizontally within the receptacle.

According to one aspect of the present invention there is provided a method of pulverising material with pulverising apparatus substantially as described above, wherein the pulverizing apparatus includes a receptacle, at least two pulverising weights and a driving mechanism linked to the receptacle, the method of pulverising material characterised by the steps of;

a) placing pulverising weights in the receptacle, wherein the pulverising weights are disposed substantially horizontally with respect to the recepitacle, and b) activating the driving mechanism, causing material (s) retained in the receptacle to be ground by the pulverising weights.

In a preferred embodiment of the present invention the motion of each pulverising weight is substantially horizontal with respect to the receptacle. The horizontal movement of each pulverising weight provides large areas within which pulverising of the sample occurs.

The term substantially horizontal may be defined to be where the two pulverising weights lie one on top of the other horizontally with respect to the receptacle, but may be also angled slightly with respect to the horizontal plane of the mills receptacle. In this manner the pulverising weights may move substantially in the horizontal plane with respect to the receptacle and also deviate slightly from the horizontal plane as they move against each other and the base of the receptacle.

Reference throughout this specification has been made to the present invention being used in laboratory pulverising applications only. It should be appreciated by those skilled in the art that the present invention may be used in many other applications apart from the laboratory, and reference to this should in no way be seen as limiting. For example the present invention may be employed in any number of industrial production lines where material needs to be pulverised and ground into a collection of small fine particles.

The present invention is configured to include a receptacle and at least two pulverising weights which are disposed substantially horizontally with respect to one another and the receptacle.

In a preferred embodiment the width of the receptacle is limited so that the pulverising weights are always retained one on top of one another. By limiting the width of the. receptacle the pulverising weights are not given enough room to fall off of one another and hence stay on top of one anther in a substantially horizontal disposition with respect to the receptacle.

In a preferred embodiment the receptacle is configured with a small enough width so that the pulverising weights are always retained one on top or another, and a large enough width so that as the weights move apart a maximum amount of surface area on the lower pulverising weight is uncovered. It is envisioned that the width of the receptacle will be increased to a point where the weights are prevented from coming off one another while maximising the amount of exposed surface area on the lower weight when the two weights move apart.

By maximising the exposed surface area of the lower weight, a larger amount of material may fall onto this exposed surface and then subsequently be ground against the returning upper weight as it swings back across the surface of the lower weight.

Pulverising occurs between the bottom pulverising weight and the floor of the receptacle, as well as between the upper surface of the bottom pulverising weight and lower surface of the top pulverising weight. In addition, pulverising of material may occur against the sides of the receptacle as well as the top lid of the receptacle via the top side of the upper pulverising weight.

When a coarse particle sample is added to the pulverising apparatus the large chips or lumps of material will be ground between the sides of the weights and the walls of the receptacle. As the particle size of the material is reduced the smaller particles will then circulate more freely through the receptacle and eventually end up on the top surfaces of the weights and be ground by the action of the weights moving against one another.

In a further embodiment of the present invention the pulverising weights are capable of slight vertical movements up the sides of the receptacle walls, when the receptacle walls are angled or sloped. Vertical movement of the pulverising weights allows material to fall underneath a pulverising weight where they are ground underneath the weight when the weight falls or moves back onto the horizontal plane.

It should be appreciated by those skilled in the art that any number of pulverising weights may be used in conjunction with the present invention. As the number of pulverising weights employed increases, the height of the receptacle used also increases. Material added to a receptacle may be ground into fine particle between each of the adjacent faces of the pulverising weights used—with the number of weights used increasing the amount of area over which the materials may be ground and pulverised.

Reference through this specification has been made to the present invention employing two only pulverising weights in a preferred embodiment. However, it should be appreciated by those skilled in the art that any number of pulverising weights may be used in conjunction with the present invention and reference to only two should in no way be seen as limiting.

In one embodiment of the present invention, the pulverising weight is shaped as a substantially flat discus. This provides the pulverising weight with a large surface area on its top and bottom surfaces, as well as allowing the weight to roll easily around sides of the receptacle when the sides of the, receptacle are of a cylindrical shape.

In a further embodiment of the present invention a pulverising weight may included angled or rounded edges which allow the weight to ride up the side wall of the receptacle to some extent In a preferred embodiment of present invention each pulverising weight used shall be of a substantially different mass to all other pulverising weights used in the apparatus.

The mass of a pulverising weight may be varied by the size of the pulverising weight compared to the other pulverising weights used, or the type of material used to construct the pulverising weight.

Reference throughout this specification shall now be made to the pulverising weights as being pulverising discs. It should be appreciated however, that other embodiments of the present invention may not use pulverising weights shaped as discs, and have some other configuration of pulverising weight.

In a preferred embodiment of the present invention the pulverising surfaces used to pulverise material are matched to fit together.

If one side of a pulverising discus is shaped into a bowl or a convex curve, then the mating side of the second pulverising discus to be used is shaped to fit inside or around the first pulverising discus.

In a preferred embodiment of the present invention the pulverising apparatus includes

- a pulverising bowl with a flat bottom surface as the receptacle,
- a lower pulverising discus with a convex curved bottom surface, and
- a concave curved top surface, and
- an upper pulverising discus with a lower surface shaped as a convex curve.

A mill configured with pulverising discs and a pulverising bowl in this manner has all the pulverising surfaces matched together, allowing a certain degree of vertical as well as horizontal movement to the pulverising discs when in operation.

In a further preferred embodiment where two discs only are used, the upper disc may have a convex curved surface on the disc's top surface. However, it should be appreciated that if more than two discs are employed, only the top disc in the receptacle will have a convex upper surface.

The use of a convex curved surface on the upper pulverising discus' top face allows material located on the top of the discus to roll off the discus surface into the lower sections of the mill.

In a preferred embodiment of the present invention the receptacle used to contained the sample material and the pulverising discs is shaped as a cylindrical bowl with a flat internal base. The curved internal walls of the bowl allow pulverising discs contained within to roll easily around the retaining walls, pulverising material as they travel.

Reference throughout the specification shall now be made to the receptacle as being a cylindrical bowl. However, it should be appreciated that other embodiments of the present invention may use a receptacle of a substantially dissimilar shape to a cylindrical bowl.

Preferably, when new the mills cylindrical bowl is configured with a flat internal base. However, this should be appreciated that over time and with extended use of the mill the cylindrical bowl's internal base may become worn and curved into a shape complementary to that of the bottom surface of the bottom discus.

However, as the major part of the grinding and pulverising work done by the mill is completed within the two mated surfaces of the discs, the wear experienced in the cylindrical bowls base does not degrade the performance of the mill. This allows the mill to be used over a long period of time without the necessary requirement of replacing the cylindrical bowls base once it has been worn into a curve.

In a preferred embodiment as an aid to minimising the cost of wear to parts of the bowl, the bowl wall may include a replaceable liner. Such a liner may consist of a specially inserted wall section, or a section of pipe of a similar size and shape to that of the bowl. These replaceable wall sections can be mounted in a base and replaced when worn through by the action of the discs rubbing against the bowl's walls.

It should be appreciated by those skilled in the art that the present invention may be used in either batch processing operations or in continuous flow processing operations.

In batch processing operations, a measured amount of material may be added to the receptacle and pulverised using the grinding weights. Once the pulverising device has been run for a set period of time it's driving mechanism may be stopped, the pulverising weights and the ground and pulverised materials removed from the receptacle.

Alternatively, the present invention may be used in continuous flow processing operations. In such operations the pulverising device may be run continuously and include inlet and outlet ports. Unground, coarse material may be added through the inlet port, be ground by the pulverising weights and then issue from the outlet port in a pulverised state.

The present invention may be configured to easily fit within an existing production line. Because of its compact configuration, any number of pulverising weights may be used in a receptacle, as an increase in the number of pulverising weights only increases the height of the receptacle and not its width. Further, several milling and pulverising devices may be linked together—with the outlet port of one device being connected to the inlet port of another device. In this manner, materials may flow continuously through a production line being ground finer and finer at each stage in the line.

Configuration of the invention in a continuous flow processing line allows the size of the particles produced by the present invention to be controlled by the flow rate of materials added to the device through its inlet port A large flow rate of material into the present invention may result in this material flooding the receptacle and passing quickly through the device. However. if a small flow rate of materials is added to the receptacle these materials may take a long time to graduate to the receptacles' outlet port, and hence be ground into small particles.

It is envisioned in a preferred embodiment that the particle size of pulverised materials produced will be controlled by the amount of time the materials are present in the receptacle when the grinding weights are moved. The longer such materials stay in the receptacle when the device is operating the finer and smaller the particle size that will result in the final pulverised material.

In a further embodiment of the present invention, where continuous flow processing is employed the pulverising device may act to pulverise particles contained within a slurry Such a slurry may be fed into the receptacle through an inlet port positioned near or at the base of the receptacle and the pulverised slurry removed from an outlet port located near or at the top of the receptacle, or vice versa.

Placing the inlet port near the base of the receptacle can ensure that the slurry takes a long time to be processed and move up to the outlet port This long processing time results in the slurry being ground into extremely fine particles.

In a preferred embodiment of the present invention the bowl includes a lid which can be clamped down securely to retain the sample material and pulverising discs inside the bowl. Such a clamping lid is required to retain the material inside the bowl during use, as the motion of the pulverising discs acts to push and spray small particles out of the top of an unsealed pulverising bowl.

A clamped lid also helps to reduce the amount of noise transmitted into the environment by the pulverising apparatus and helps to prevent sample contamination during the pulverising process.

In a preferred embodiment of the present invention the sample receiving capacity of the bowl may be varied depending of the amount of sample required to be ground in one operation. The amount of sample the pulverising bowl may receive is varied by adjusting the height of the lid clamped onto the bowl. The lid may be lowered down into the bowl to a height convenient to retain a small amount of sample, and in some embodiments provide an additional surface against which the pulverising discus may pulverise material. In this manner the effective height of the receptacle may be changed.

For larger volumes of sample the bowl lid may be clamped at greater heights inside the bowl or onto the very top of the pulverising bowl. This allows larger variations in the amount of sample the pulverising apparatus may process, from forcing a small amount of material to be ground in small volume, to allowing a large amount of material to be ground in a larger volume.

In an alternative embodiment of the present invention the pulverising apparatus is configured to allow supply of additional sample material during operation, and removal of adequately processed sample during operation.

The apparatus may be configured in one embodiment to include a supply spout or aperture in the bowl lid allowing sample to be added to the apparatus while the apparatus is in operation.

In addition, another embodiment of the present invention may include a screen in the outlet of the bowl to allow the transmission of the required size particles into a processed sample reservoir during operation.

In a further alternative embodiment, removal of adequately processed sample from the receptacle may not be via a screen. For example, in an alternative embodiment a small aperture or port may be located in the centre of the bowl and material allowed to exit through this port when the bottom discus in the mill moves off the outlet port. In this manner material may be removed from such an outlet port once it has progressed through the receptacle from a supply spout down through the pulverising discus' and out through the outlet port As can readily be appreciated by one skilled in the art the present invention is much more efficient than a standard ball mill used in a continuous flow processing application. The present invention employs a much greater grinding surface area for the weight of apparatus used than a ball mill, which only has an extremely small grinding surface area for the mass of the balls used.

In a preferred embodiment of the present invention the driving mechanism used to impart motion to the pulverising discus is the same driving mechanism used to drive existing ring mills or discus mills This driving mechanism consists of a rotating shaft powered by a motor, with a weight attached to the shaft at an off centre position so the centre of mass of the weight changes as the motor shaft is rotated.

The pulverising bowl is fixed to a horizontal platform mounted on a set of springs. A driving motor, which vibrates the bowl, is attached to the underside of the platform.

As the off centre weight is rotated by the driving motor the pulverising bowl is caused to vibrate, while rotation of the off centre mass imparts limited horizontal movement to the pulverising bowl. Ibis configuration of driving mechanism causes the pulverising discs to move substantially in their horizontal plane, as well as vertically to a small extent due to the vibrations of the apparatus transmitted through the mounting springs.

Alternative embodiments may not employ driving apparatus with a weight attached to a shaft in off set position. For example, in an alternative embodiment driving apparatus with an eccentric bearing may be used—where the entire receptacle is mounted offset to the drive shaft of the apparatus, imparting eccentric horizontal movement to the pulverising bowl.

In further alternative embodiments other forms of driving apparatus may be used in conjunction with the present invention. For example, when a large flow through processing milling apparatus is configured in accordance with the present invention, a single driving mechanism may not be able to transfer enough energy to the device to operate it effectively. In this case several driving mechanisms may be required to drive the apparatus.

The driving mechanism of the present invention may in some embodiments be configured to drive the pulverising apparatus approximately 50% faster than the standard driving frequency of existing ring mills and discus mills. This increase in driving frequency increases the efficiency of the driving apparatus, resulting in much quicker processing of samples inserted into the pulverising bowl.

However, the efficiency of the present invention means that an increase in speed is not necessary to have a better performance over conventional mills.

The applicant has also found that the power consumption requirements of a driving mechanism used in conjunction with the present invention are notably reduced when compared with power consumption for a standard ring mill. This power saving may be "re-invested", to drive the driving mechanism approximately 50% faster than normal, giving quicker processing.

The present invention has many advantages over existing rock pulverising devices.

Using two or more pulverising discs considerably increases the efficiency of the pulversing apparatus compared with existing pulverising devices. The pulverising surface area is greatly increased, with pulverising occurring between the surfaces of the pulverising discus and the pulverising bowl, as well as between the surfaces of two or more adjacent pulverising discs.

The variable capacity of the pulverising apparatus also allows a variable size sample to be added to the pulverising bowl. The capacity of the pulverising bowl may be varied depending on the size of the sample inserted, with the volume reduced to allow easy contact between the pulverising discs and the lid of the pulverising bowl.

Increasing the frequency of the driving apparatus also increases the speed of operation of the device. Small sized particle mixes of a highly homogeneous nature are provided by the pulverising apparatus in a much shorter time period than would normally be possible with existing pulverising technology.

The use of multiple pulverising discs allows an operator to easily remove the mill discs without need of a mechanical lifting device. This decreases the expense of the invention, with the entire weight of a large pulverising discus broken down into several components which may be lifted out of the mill one by one by an operator.

The use of a convex top surface on a pulverising discus allows material located on the top of the discus to roll off the surface and back into the middle and centre of the pulverising bowl. This feature promotes ready recirculation of sample material during operation.

The present invention may operate effectively after continued use where the discs have worn the base of the pulverising bowl into a curve. This is of great advantage compared to existing milling and pulverising devices where bases of these mills worn into curves must be replaced if the mill is to operate effectively. This creates a large cost and time saving to the operator of the present invention.

BRIEF DESCRIPTION OF DRAWINGS

Further aspects of the present invention will become apparent from the following description which is given by way of example only and with reference to the accompanying drawings in which.

Figure 1:
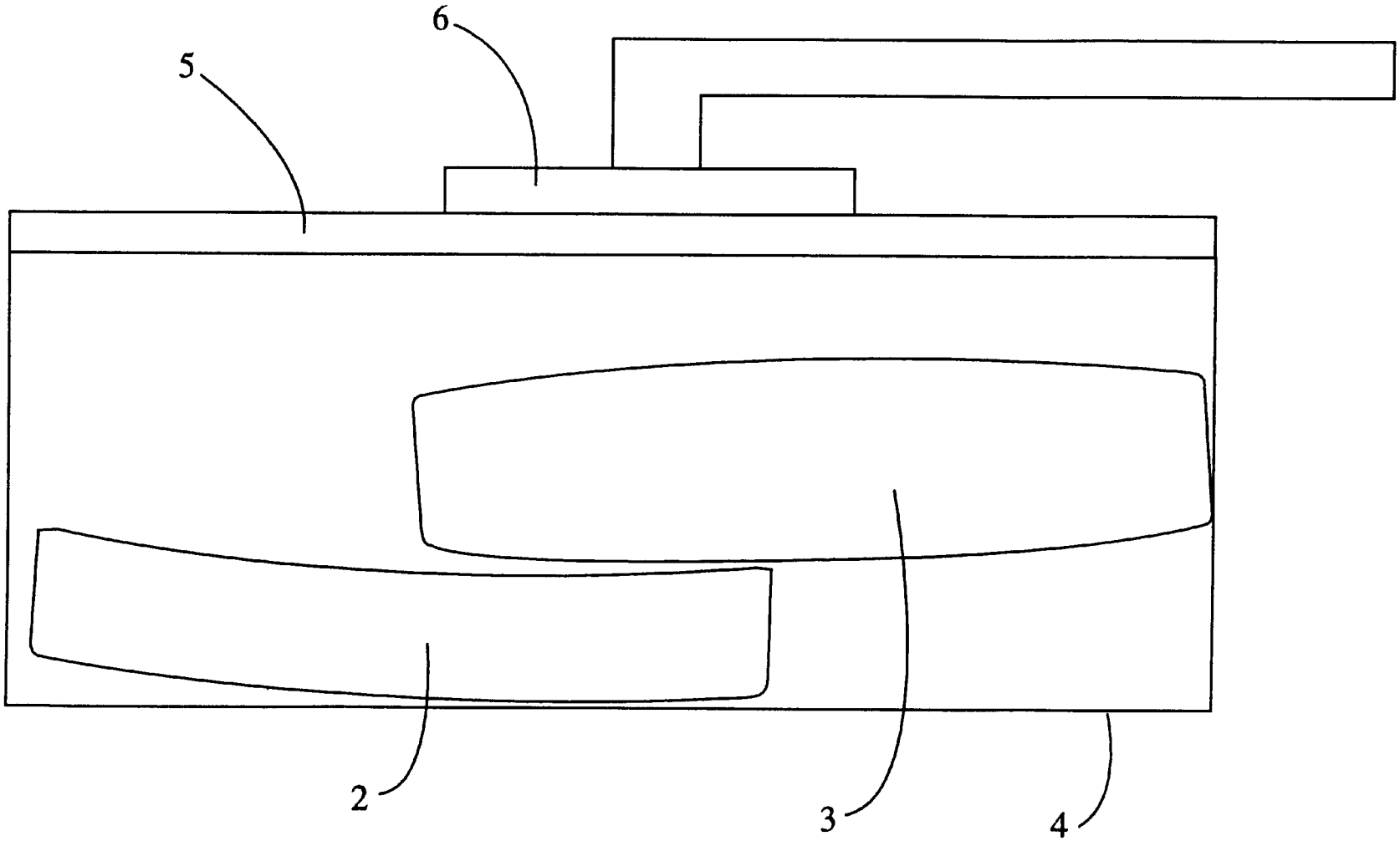
FIG. 1 a cross sectional view of the pulverising apparatus.

Table 1–4 illustrates experimental data obtained through use of the present invention.

BEST MODES FOR CARRYING OUT THE INVENTION

FIG. 1 illustrates a schematic view of the pulverising apparatus 1.

Pulverising apparatus 1 includes pulverising weights, in this embodiment pulverising discus 2 and pulverising discus 3.

Pulverising discus 3 is positioned on top of pulverising discus 2, with both discs being oriented substantially horizontally with respect to the pulverising apparatus 1.

Pulverising discs 2 and 3 are configured so that the adjacent sides of each discus are matching surfaces. As shown in FIG. 1 and FIG. 2 pulverising discus 2 has an upper concave curved surface, while pulverising discus 3 has a lower convex curved surface, which fits easily into the top surface of pulverising discus 2.

The upper surface of pulverising discus 3 is shaped as a convex curve. This allows any material present of the top surface of pulverising discus 3 to roll off the top of the pulverising discus back down into the centre and bottom of the pulverising bowl 4.

Both pulverising discs 2 and 3 are located within the pulverising receptacle, in this case pulverising bowl 4. Pulverising discs 2 and 3 may move horizontally within pulverising bowl 4 to pulverise material against the vertical wall and floor of pulverising bowl 4. Pulverising of material may also occur at the interface between pulverising discus 2 and pulverising discus 3 when the contacting surfaces of each discus move against each other.

As can be seen from the diagram the receptacle is configured with a large enough width so that a large proportion of discus 2 is exposed when discus 3 moves off to the other side of the receptacle 4. This feature allows the top surface of discus 2 to collect a large amount of material which may then be pulverised as discus 3 moves back across discus 2.

Pulverising bowl 4 also includes a lid 5 which retains the material and pulverising discs 2 and 3 in the pulverising bowl 4.

Lid 5 is held in contact with pulverising bowl 4 with use of clamp 6. Clamp 6 ensures that lid 5 is held tightly against pulverising bowl 4 so no material may escape from the pulverising apparatus when in use.

Table 1 shows experimental data results from an extended trial of the present invention.

Table 1 shows data obtained from trials A and B, where the same amount of material was processed for the same time using two different sets of discus'. These discs weighed 8.2 kilos and 7.5 kilos in total respectively. This trial showed that despite an 8.5% loss in discus' mass, the resulting differences between particle consistency and size in the two trials was small.

Table 2 shows the results of a similar trial to that shown in Table 1. In this case a 14.6% difference in total discus weight resulted in only a 1.5% reduction in the devices performance.

Table 3 shows the results of a further trial which compared the performance of a known ring mill with the present invention, where approximately twice the mass of material was added to the present invention's receptacle than to the receptacle containing the puck and rings. As can be seen from these results the invention performed to the same standard as the puck and ring mill, was used over the same period of time—but processed approximately 71% more material.

Table 4 shows the current drawn by the driving apparatus used in the trials E and F conducted with respect to Table 3. As can be seen from these results the present invention draws on average less current through its driving apparatus while processing a larger amount of material.

Aspects of the present invention have been described by way of example only and it should be appreciated that modifications and additions may be made thereto without departing from the scope thereof as defined in the appended claims.

What is claimed is:

1. Pulverising apparatus including a receptacle, and at least two pulverising weights, characterized in that the pulverising weights are disposed substantially horizontally within the receptacle, at least one of the pulverising weights is disposed substantially on top of another one ofthe pulverising weights, and the pulverising weights are shaped as substantially flat disks with rounded edges and complementary mating surfaces which are configured to confine the movement of the pulverising weights relative to the receptacle and each other substantially in a horizontal direction.

2. Pulverising apparatus as claimed in claim 1 wherein the pulverising weights include flat angled edges.

3. Pulverising apparatus as claimed in claim 1 wherein the pulverising weights include mating surfaces which allow one pulverising weight to fit substantially inside one surface of another pulverising weight.

4. Pulverising apparatus as claimed in claim 3 wherein the pulverising of material added to the pulverising apparatus occurs substantially between the two mated surfaces of the pulverising weights.

5. Pulverising apparatus as claimed in claim 1 wherein an upper pulverising weight has a bottom surface including a convex curve and a lower pulverising weight has a top surface including a concave curve which in use mates with the convex curve on the bottom surface of the upper pulverising weight.

6. Pulverising apparatus as claimed in claim 5 wherein the upper pulverising weight has a top surface which includes a convex curve.

7. Pulverising apparatus as claimed in claim 5 wherein the lower pulverising weight has a bottom surface which includes a convex curve.

8. Pulverising apparatus as claimed in claim 1 wherein each of the pulverising weights is of a different mass.

9. Pulverising apparatus as claimed in claim 1 wherein the receptacle is a cylindrical bowl with a flat base.

10. Pulverising apparatus as claimed in claim 1 wherein the receptacle includes a lid capable of being clamped to a top portion of the receptacle.

11. Pulverising apparatus as claimed in claim 1 wherein the receptacle has an effective height which is selectively changeable to vary the capacity of the receptacle.

12. Pulverising apparatus as claimed in claim 11 wherein the effective height of the receptacle is changed by placement of the lid within an inside surface of the receptacle.

13. Pulverising apparatus as claimed in claim 12 wherein the receptacle includes a supply aperture to allow material to be added to the receptacle during use of the pulverising apparatus.

14. Pulverising apparatus as claimed in claim 13 wherein the receptacle incorporates a screen which allows particles of a particular size to pass through the screen.

15. Pulverising apparatus as claimed in claim 14 wherein the receptacle includes a collection container adapted to collect material passing through the screen of the receptacle.

16. Pulverising apparatus as claimed in claim 1 wherein during use of the pulverising apparatus the pulverising weights move substantially in a horizontal plane with respect to the receptacle.

17. Pulverising apparatus as claimed in claim 1 wherein the pulverising apparatus includes a driving mechanism from an existing milling apparatus.

18. A method of pulverising materials characterized by the steps of:

(a) placing at least two pulverising weights in a receptacle, wherein the pulverising weights are disposed substantially horizontally with respect to the receptacle, and at least one of the pulverising weights is disposed substantially on top of another one of the pulverising weights; and (b) activating a driving mechanism, causing materials retained in the receptacle to be ground by the pulverising weights, wherein the pulverising weights are shaped as substantially flat discs with rounded edges such that the movement thereof relative to the receptacle and each other is substantially in a horizontal direction.

* * * * *